US005388726A

United States Patent [19]

Otake

[11] Patent Number: 5,388,726

[45] Date of Patent: Feb. 14, 1995

[54] DOUBLE-STRUCTURED PACKAGE OF ONE-SHOT-PUSH SQUEEZE-OUT TYPE FOR ADHESIVE

[75] Inventor: Masaaki Otake, Ohmiya, Japan

[73] Assignee: Sekisui-Iko Company, Limited, Tokyo, Japan

[21] Appl. No.: 34,014

[22] Filed: Mar. 22, 1993

[30] Foreign Application Priority Data

Apr. 14, 1992 [JP] Japan ..... 4-094305

[51] Int. Cl.[6] ..... B67D 5/00

[52] U.S. Cl. ..... 222/83; 222/183

[58] Field of Search ..... 222/131, 154, 151, 206, 222/215, 214, 209, 81, 83, 190, 325, 420, 183; 220/267, 277, 278; 215/250; 401/156, 192

[56] References Cited

U.S. PATENT DOCUMENTS

| | | | |
|---|---|---|---|
| 2,492,830 | 12/1949 | Bannister | 222/190 |
| 3,066,834 | 12/1962 | Kingsbury | 222/215 |
| 3,223,289 | 12/1965 | Bouet | 222/209 |
| 3,406,875 | 10/1968 | Park | 222/151 |
| 3,454,196 | 7/1969 | Hazard | 222/83 |
| 4,146,152 | 3/1979 | Ogawa et al. | 222/151 |
| 4,389,419 | 5/1983 | Valdez | 401/195 |
| 4,634,023 | 1/1987 | Tanaka et al. | 222/214 |
| 4,958,748 | 9/1990 | Otake | 222/131 |
| 5,156,303 | 10/1992 | Yamamoto | 222/81 |

FOREIGN PATENT DOCUMENTS

| | | | |
|---|---|---|---|
| 0155471 | 9/1985 | European Pat. Off. . | |
| 0367874 | 5/1990 | European Pat. Off. . | |
| 2389419 | 12/1978 | France . | |
| 91/12198 | 8/1991 | WIPO | 222/83 |

*Primary Examiner*—David M. Mitchell
*Assistant Examiner*—Philippe Derakshani
*Attorney, Agent, or Firm*—Jordan and Hamburg

[57] ABSTRACT

A double-structured package which is for an adhesive and can be subjected to one-shot pushing to squeeze out the adhesive from the package. The package comprise a soft elastic container in which the adhesive is stored; a soft elastic case housing the container except at least the outlet port of its front end so that the case can be pushed from outside to press the container to squeeze out the adhesive from it through the outlet port; and a cap removably fitted on the case so that the cap covers the outlet port of the container and the head of the case.

10 Claims, 4 Drawing Sheets

DOUBLE-STRUCTURED PACKAGE OF ONE-SHOT-PUSH SQUEEZE-OUT TYPE FOR ADHESIVE

BACKGROUND OF THE INVENTION

The present invention relates to an improved double-structured package which is for an adhesive, particularly an instantly-set adhesive, and can be subjected to one-shot pushing to squeeze out the adhesive from the package to apply the adhesive to the desired part of an object.

When a conventional container for an adhesive is to be put away, a container cap is fitted on the container, they are then put in a case, and a case cap is thereafter fitted on the case. When the adhesive is to be squeezed out from the container, the case cap is removed from the case, the container is taken out from the case, the container cap is removed from the container, and the container is then pressed to drive out a desired quantity of the adhesive from the container through the outlet port thereof. At that time, if a part of the adhesive has already set in the outlet port to hinder the squeezing-out of the adhesive, the pin of a holer provided separately from the container is stung into the set part of the adhesive to make a hole therein to render it possible to squeeze out the adhesive from the container.

Each of such conventional containers is a single-structured tube although each of some of them is a tube made of a plurality of materials overlaid together. The containers are not made of transparent materials through which the adhesive in each container can be seen to find out the amount of the adhesive. Since each of the containers is put in a case except at the time of the squeezing-out of the adhesive and taken out from the case at that time, it is troublesome to handle the container. Since a holer having a pin for making a hole in the set part of the adhesive remains simply put in a cap before the cap is removed from the case for the first time to take out the container from the case, the holer is likely to rush or drop out from the cap at the time of the removal or become lost at the time of handling or putting-away of the container. If the holer is lost in a room, it can be dangerous for a little child or the like. If the pin is stung into the container by accident or mistake, the adhesive leaks out therefrom. If the adhesive leaking out from the container clings to a finger, the adhesive can be uneasy to be wiped off it or can cause a skin inflammation in the finger.

As for a pen-like container for an adhesive, it cannot be put out from the container unless the container is pushed onto an adhesive-applied object. The adhesive is likely to be excessively put out from the container and cling to the tip of the container or a finger to cause a skin inflammation therein.

An adhesive package was filed by the present applicant, and disclosed in the Japan Utility Model Laid-open No. 99476/1989 and the Japan Patent Application No. 914/1991. Since the constitution of the package makes it impossible to hermetically seal the adhesive container of the package, the container is exposed to the external 3it to accelerate the deterioration of the adhesive in the container to make it impossible to store the adhesive therein for a long time. If the adhesive is an alpha-cyano adhesive, it whitens due to the external air.

SUMMARY OF THE INVENTION

The present invention was made in order to solve the above-described problems of the conventional containers and package. Accordingly, it is an object of the invention to provide a double-structured package which is for an adhesive and can be subjected to one-shot pushing to squeeze out the adhesive from the package. The adhesive can be stored in the package for a long time. It is easy to handle the package to squeeze out the adhesive therefrom or put away the package. Hands are unlikely to be contaminated with the adhesive when the package is handled by the hands. Therefore, the package can be handled with safely and cleanness.

The double-structured package comprises a soft elastic container in which the adhesive is stored; a soft elastic case housing the container except at least the outlet port of the front end thereof so that the case can be pushed from outside to press the container to squeeze out the adhesive therefrom through the outlet port thereof; and a cap removably fitted on the case so that the cap covers the outlet port of the container and the head of the case.

The soft elastic case may be so transparent or translucent that the adhesive in the soft elastic container housed in the case can be seen through it to find out the amount of the adhesive.

The soft elastic case may have a desiccant chamber between the bottom of the case and that of the soft elastic container so that a desiccant can be provided in the chamber to prevent the adhesive from whitening and keep the inner surface of the case from collecting moisture, thus to heighten the adhesive preserving property of the package.

A holer having a pin may be removably fitted in the appropriate portion of the cap so that the holer does not become lost before the first squeezing-out of the adhesive and during the handling of the package. If a portion of the adhesive has set in the outlet port of the container to close the port, the pin of the holer is stung into the portion to open the port.

When the adhesive is to be squeezed out from the double-structured package and applied to an object, the cap is removed from the case and the body of the case is then pinched at the dimples thereof so as to be elastically deformed inward to press the container at the mutually opposite portions of the peripheral surface thereof in the case so that a quantity of the adhesive, which corresponds to the degree of the pressing, is squeezed out from the container through the outlet port of the front end thereof without directly touching the container in the case. The adhesive can thus be squeezed out from the package and applied to the object in an easy simple manner.

When the pinching the body of the case at the dimples thereof is ceased after the squeezing-out of the adhesive, an adhesive portion driven forth to the vicinity of the outlet port of the container at the time of the squeezing-out is sucked back into the container so that the adhesive portion is unlikely to drop from the outlet port or cling around it to contaminate the vicinity of the port, a finger, clothes or the like. Therefore, the container is always clean at the outlet port, and it is safe and easy to handle the package.

Although the adhesive cannot be put out from the above-mentioned conventional pen-like container without pushing it onto the object and it is therefore difficult to control the put-out quantity of the adhesive, the case and container of the double-structured package are so soft and elastic that the squeezing pressure thereon can be finely modulated to control the squeezed-out quantity of the adhesive and it can be appropriately squeezed out and applied to a deep narrow place, a ruggedly undulating place, a brittle object, a soft object or the like.

Since the adhesive can be hermetically sealed in the double-structured package so as to be completely kept off the external air, the adhesive can be stored in the package for a long time.

Since the package is double-structured, the adhesive is unlikely to leak out therefrom when the package undergoes external damage.

DESCRIPTION OF THE DRAWINGS

FIG. 1(*b*) is a rear view of the package;

FIG. 4(*b*) is a sectional view of the cap along lines IVb in FIG. 4 (*c*);

FIG. 4(*c*) is a rear view of the cap;

FIG. 5(*b*) is a sectional view of the latter cap along lines Vb in FIG. 4(*a*), in the state that a holer having a pin is about to be fitted in the cap.

DETAILED DESCRIPTION OF EXEMPLARY EMBODIMENT

An embodiment of the present invention is hereafter described in detail with reference to the drawings attached hereto.

Figure 1B:
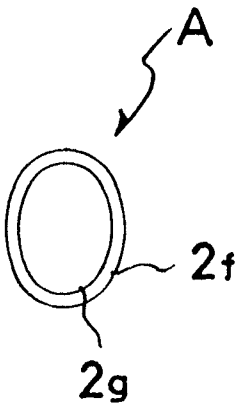
FIG. 1(*a*) is a side view of a double-structured package which is an embodiment of the present invention and is for an adhesive so that it can be squeezed out from the package by the one-shot pushing thereof as the cap of the package is removed from the other portion thereof as shown in the drawings.
Figure 1A:
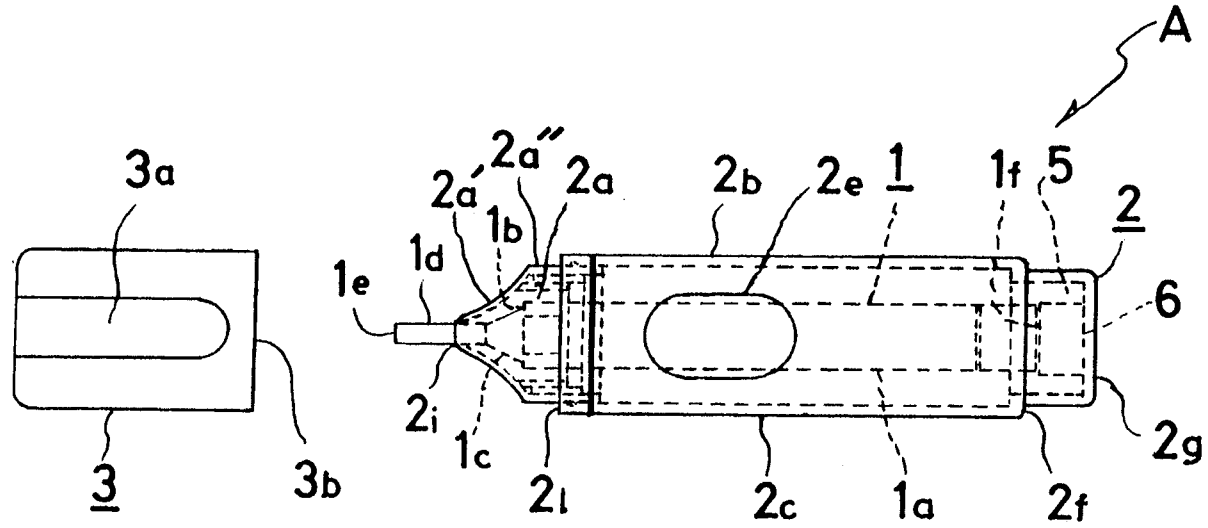
Figure 2:
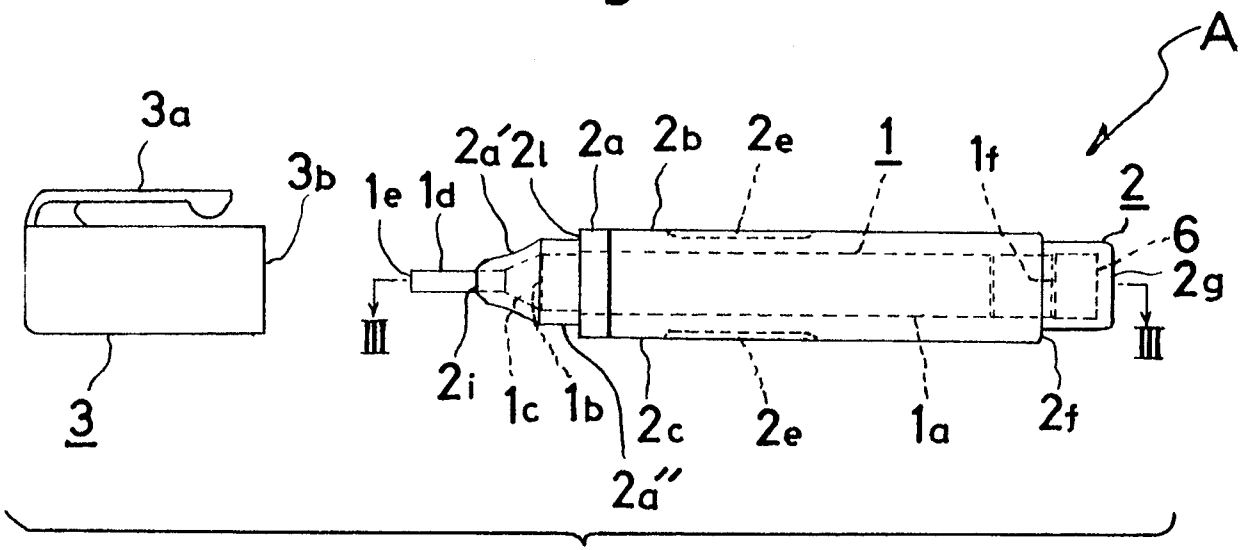
FIG. 2 is a plan view of the package in the state that the cap is removed from the other portion of the package.
Figure 3:
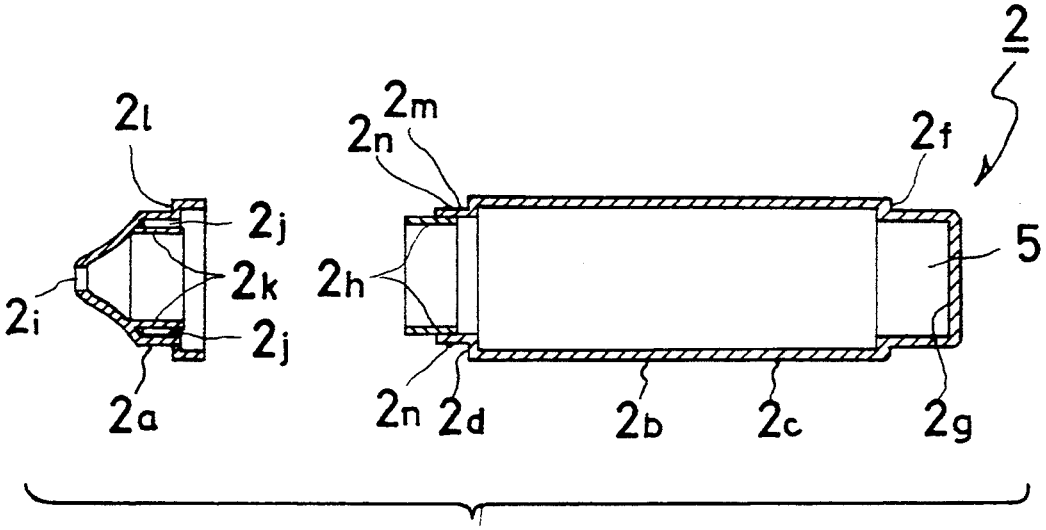
FIG. 3 is an exploded sectional view of the soft elastic case of the package along lines III in FIG. 2, in the state that the conical head and body of the case are uncoupled from each other.

FIGS. 1(*a*), 1(*b*), 2 and 3 show a double-structured package A which is the embodiment and is for an adhesive which can be squeezed out from the package by the one-shot pushing of the package. The package A includes a soft elastic container 1 in which the adhesive is stored; a soft elastic case 2; a cap 3; a desiccant chamber 5; and desiccant 6.

The container 1 is made of a soft elastic material which is polyethylene or polypropylene if the adhesive is an alpha-cyano adhesive. The container 1 includes a cylindrical body 1*a*, a shoulder 1*b*, a conical neck 1*c*, a thin tubular portion 1*d*, through which the adhesive is squeezed out from the container, an outlet port 1*e*, through which the adhesive is squeezed out from the container, and a bottom 1*f*. The conical neck 1*c* tapers from the shoulder 1*b* to the thin tubular portion 1*d*. The outlet port 1*e* is provided in the thin tubular portion 1*d* at the front end thereof, and is closed until the start of the first squeezing-out of the adhesive so that the port can be opened by a holer 4 having a pin 4*a* and shown in FIGS. 4(*a*), 4(*b*), 5(*a*) and 5(*b*), scissors or the like.

The case 2 is made of a soft elastic material. It is preferable that the case is transparent or translucent to make it possible to see through the case. The case 2 may be colored and translucent, and also be transparent indoors and translucent due to sunlight outdoors. For example, the material is polyacetal, polyacrylonitrile, polyethylene, polypropylene, polyethylene terephthalate, polyvinyl chloride, polyvinylidene chrolide, nylon, or the like. The case 2 includes a conical head 2*a*, and a body 2*b*. The main portion 2*c* of the body 2*b* is a cylindrical bottomed hollow portion having an elliptic cross section, and has finger engagement dimples 2*e* in the peripheral surface of the portion so as to make it easy for fingers to pinch the portion. The body 2*b* has a shoulder 2*d*, a step 2*f*, a bottom 2*g*, a cylindrical portion 2*h*, a neck 2*m*, and an annular projection 2*n*. The neck 2*m* adjoins the main portion 2*c* at one end of the neck, and the cylindrical portion 2*h* at the other end of the neck, and is smaller in outside diameter than the main portion but larger in outside diameter than the cylindrical portion. The portion of the body 2*b*, which extends from the step 2*f* to the bottom 2*g*, is a cylindrical portion smaller in outside diameter than the main portion 2*c*, and has the desiccant chamber 5 between the bottom 2*g* and that if of the container 1. The desiccant 6 is provided in the chamber 5. The chamber 5 and the desiccant 6 may not be provided if they are not necessary.

The conical head 2*a* of the case 2 tapers forward from the body 2*b* thereof, and has an opening 2*i* through which the thin tubular portion 1*d* of the container 1 housed in the case extends forward. The head 2*a* has a collar 2*l* having an elliptic cross section of the same form and size as the body 2*c* of the case, an inner ring 2*k*, and an annular groove 2*j* defined between the outer circumferential surface of the ring and the inner circumferential surface of the head. When the head 2*a* and the body 2*b* are assembled to constitute the case 2, the collar 2*l* adjoins the shoulder 2*d* of the body, the cylindrical portion 2*h* of the body is fitted on the neck 2*m* and in the annular groove 2*j*, and the annular projection 2*n* is firmly engaged in the collar.

The cap 3 is made of the same material as the case 2, and has an elliptic cross section of the same size as the front end of the body 2*b* of the case. The cap 3 has a clip 3*a* and an open end 3*b*. The cap 3 has such a thickness that it can be either fitted on the elliptic outer circumferential surface of the head 2*a* of the case 2 or removed therefrom.

When the adhesive is to be squeezed out from the container 1, the cap 3 is first picked and pulled by the thumb and index finger of a hand so that the cap is removed from the head 2*a* of the case 2. As a result, the thin tubular portion 1*d* of the container 1 is exposed at the outlet port 1*e* thereof. If the adhesive is to be squeezed out for the first time, the pin 4*a* of the holer 4 is stung into the thin tubular portion 1*d* at the front end thereof or the portion is cut off at the front end thereof, so that the outlet port 1*e* is created. The holer 4 includes a hollow cylindrical body 4*c* having a circular cross section, a knob flange 4*b* extending from the body, larger in outside diameter than it and having an anti-slipping peripheral surface, and the pin 4*a* extending from the inside surface of the flange and projecting slightly out of the open end of the body. The outlet port 1*e* is then located at the desired portion of an object to which the adhesive is to be applied. The main portion 2*c* of the body 2*b* of the soft elastic case 2 is thereafter pinched by the thumb and index finger of another hand in the dimples 2*e* of the main portion to elastically deform it to press the body la of the soft elastic container 1 housed in the case. As a result, the peripheral surface of the body 1*a* of the container 1 is depressed so that the adhesive stored therein is squeezed out from the container through the outlet port 1*e* thereof and applied to the desired portion of the object. At that time, the squeezed-out quantity of the adhesive can be finely modulated in terms of the degree of the pinching of the case 2 at the dimples 2*e* thereof.

After the adhesive is thus squeezed out from the container 1, pinching the main portion 2*c* of the body 2*b* of the case 2 is ceased so that the container and the case restore their original forms due to their elasticity. At that time, the adhesive in the thin tubular portion 1*d* is sucked back into the body 1*a* of the container 1 so that the adhesive is prevented from dropping out from the outlet port 1*e* or clinging around it. The pin 4*a* of the holer 4 is thereafter pushed into the thin tubular portion 1*d* through the port 1*e* so that the cylindrical body 4c of the holer is tightly fitted on the front end of the thin tubular portion to hermetically close the port. The cap 3 is then pushed onto the case 2 until the bottom of the cap comes into contact with the collar 2*l* of the head 2*a* of the case. The case 3 is thus firmly fitted on the case 2 at the head 2*a* thereof. To squeeze out the adhesive from the container 1 next time, the cap 3 is removed again from the head 2*a* of the case 2, and the pin 4*a* of the holer 4 is then pulled out from the outlet port 1*e* of the container 1 to open the port.

When the emptied container 1 is to be replaced with a full one, the head 2*a* of the case 2 is detached from the body 2*b* thereof and the full container is then fitted in the case.

Shown at 2*a*′ and 2*a*″ in FIGS. 1(*a*) and 2 are the outer elliptic circumferential surfaces of the anterior and intermediate portions of the conical head 2*a* of the case 2, respectively.

Figure 4C:
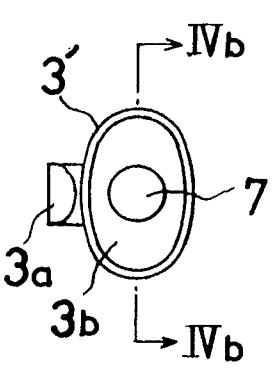
FIG. 4(*a*) is a side view of a cap which is a modification of that of the package.
Figure 4B:
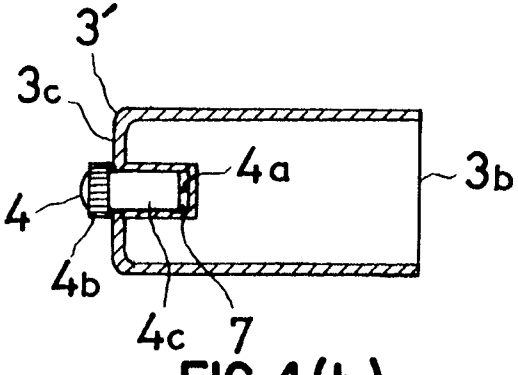
Figure 4A:
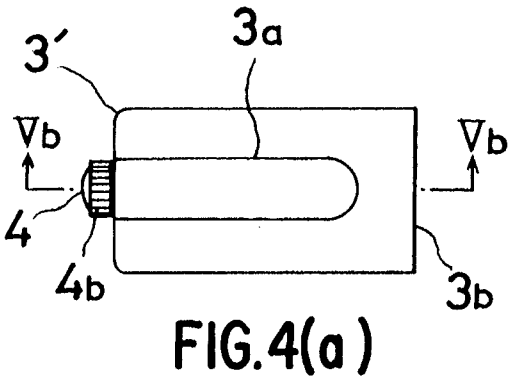
Figure 5B:
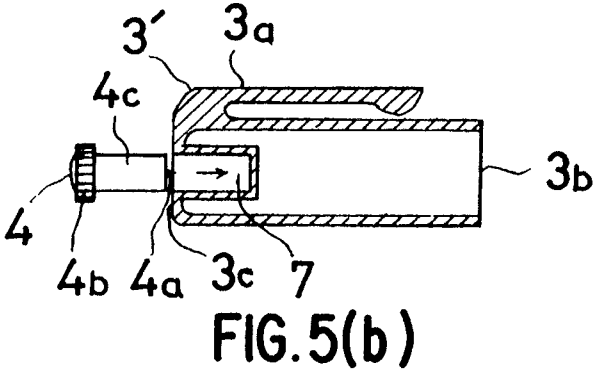
FIG. 5(*a*) is a bottom view of the latter cap.
Figure 5A:
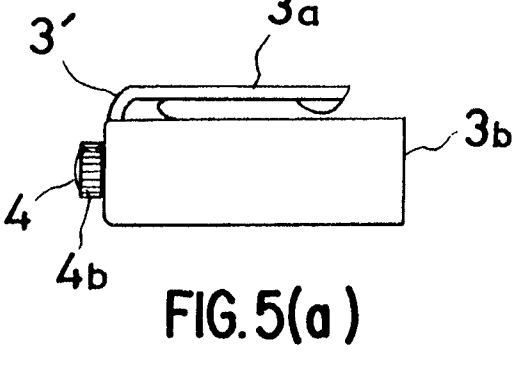

FIGS. 4(*a*), 4(*b*), 4(*c*), 5(*a*) and 5(*b*) show a cap 3′ which is a modification of the former 3 and is larger in length than it. The cap 3′ has a clip 3*a*, an open end 3*b*, and a pin-receiving well or recess 7 at the center of a head 3C of the cap. When the holer 4 is not used, it can be removably fitted in the recess 7 so as not to become lost.

The present invention is not confined to the above-described embodiment and modification, but may be embodied or practiced in other various ways without departing from the spirit or essential character of the invention. For example, although the cross section of each of the case 2 and the caps and 3′ is elliptically shaped, it may be otherwise shaped.

What we claimed is:

1. A double-structured package used for an adhesive comprising:

an elongated plastic container in which said adhesive is stored, said container having a longitudinal axis, said container having one longitudinal end formed with a discharge nozzle;

an elongated casing in which said plastic container is disposed, said casing having a longitudinal axis, said casing having one longitudinal end formed with an opening which is penetrated by said container such that said discharge nozzle of said container extends externally of said casing;

a cap removably fitted on said casing for covering said one longitudinal end of said casing and for covering said discharge nozzle;

said casing having a side wall which extends generally parallel to the longitudinal axis of the casing, said casing having indentations in said side wall, said indentations being manually pressable by a person's fingers in a direction generally perpendicular to the longitudinal axis of said casing to thereby squeeze the container to effect discharge of the adhesive through said discharge nozzle, said indentations being formed in said side wall such that the thickness of the side wall underlying said indentation is less than the thickness of said side wall juxtaposed to said indentation.

2. A double-structure package according to claim 1 wherein there are two of said indentations which are opposed to one another on opposite sides of the longitudinal axis of said casing.

3. A double-structure package according to claim 1 wherein said container has two longitudinal ends, one of said longitudinal ends being formed with said discharge nozzle, said container having a second longitudinal end, said casing having two longitudinal ends, one of said longitudinal ends being formed with said opening, said casing having a second longitudinal end, said second longitudinal end of said container being spaced from said second longitudinal end of said casing to thereby define a chamber between said second longitudinal end of said container and said second longitudinal end of said casing, and desiccant means in said chamber.

4. A double-structure package according to claim 1 wherein said side wall of said casing is transparent such that the adhesive in said container can be seen through said side wall of said casing to determine how much adhesive is in said container.

5. A double-structure package according to claim 1 wherein said cap has a side wall and an end wall, a pin-receiving well disposed within said cap, said pin-receiving well opening up onto said end wall of said cap, and pin means removably retained in said pin-receiving well such that said pin means is manually removable from said pin-receiving well to effect initial opening of said discharge nozzle of a sealed and fresh container containing adhesive and to effect closure of said discharge nozzle after said initial opening.

6. A double-structure package according to claim 5 wherein said cap has a generally hollow interior, said pin-receiving well extending from said end wall into said hollow interior of said cap.

7. A double-structure package according to claim 6 wherein said pin-receiving well has a side wall and a bottom wall which define a hollow interior, said side wall and bottom wall of said pin-receiving well closing off the hollow interior of the pin-receiving well from the hollow interior of the cap.

8. A double-structure package according to claim 7 wherein said pin means comprises a knob which is disposed outside of said pin-receiving well.

9. A double-structure package according to claim 5 wherein said pin means comprises a hollow cylindrical body having a knob at one longitudinal end of said hollow cylindrical body, said pin means further comprising a pin element extending from said knob and disposed axially within said hollow cylindrical body.

10. A double-structured package used for an adhesive comprising:

an elongated plastic container in which said adhesive is stored, said container having a longitudinal axis, said container having one longitudinal end formed with a discharge nozzle;

an elongated casing in which said plastic container is disposed, said casing having a longitudinal axis, said casing having one longitudinal end formed with an opening which is penetrated by said container such that said discharge nozzle of said container extends externally of said casing;

said casing having indentations which are adapted to be pressed by a person's fingers generally perpendicular to the longitudinal axis of the casing to thereby effect squeezing of said container to provide for discharge of adhesive through said discharge nozzle, said casing having a casing wall, said indentations being formed in said casing wall such that the thickness of the casing wall underlying said indentations is less than the thickness of the casing wall juxtaposed to said indentations;

a cap removably fitted on said casing for covering said one longitudinal end of said casing and for covering said discharge nozzle;

said cap having side walls and an end wall, a pin-receiving well disposed within said cap, said pin-receiving well opening up onto said end wall of said cap; and pin means removably retained in said pin-receiving well such that said pin means is manually removable from said pin-receiving well to effect initial opening of said discharge nozzle of a sealed and fresh container containing adhesive and to effect closure of said discharge nozzle after said initial opening.

* * * * *